US006006669A

United States Patent [19]

Klein et al.

[11] Patent Number: 6,006,669

[45] Date of Patent: Dec. 28, 1999

[54] APPARATUS FOR AFFIXING REMOVABLE NOTES TO A MOVING WEB

[75] Inventors: David M. Klein, Fontana, Wis.; Steven J. Siler, Cary, Ill.

[73] Assignee: Hurletron, Incorporated, Lincolnshire, Ill.

[21] Appl. No.: 09/154,960

[22] Filed: Sep. 17, 1998

[51] Int. Cl.[6] ..... B41F 31/00

[52] U.S. Cl. ..... 101/485; 40/638; 156/361; 156/362; 156/230; 156/238; 156/247; 270/52.13; 225/100; 225/106

[58] Field of Search ..... 101/485, 288; 283/81; 156/361, 362, 363, 230, 238, 240, 241, 243, 250; 270/52.13, 52.09; 225/4, 100, 106; 400/708

[56] References Cited

U.S. PATENT DOCUMENTS

| | | | |
|---|---|---|---|
| Re. 32,490 | 9/1987 | Jenkins | 156/250 |
| 3,143,342 | 8/1964 | Pine et al. | 270/52.5 |
| 3,178,170 | 4/1965 | Walck et al. | 270/58 |
| 3,493,156 | 2/1970 | Absler et al. | 225/100 |
| 4,351,517 | 9/1982 | Neal et al. | 270/52 |
| 4,522,672 | 6/1985 | Brister et al. | 101/288 |
| 4,584,048 | 4/1986 | Hamisch, Jr. et al. | 101/288 |
| 4,599,129 | 7/1986 | Kerwin | 101/35 |
| 4,920,882 | 5/1990 | Hoyt | 400/708 |
| 4,954,203 | 9/1990 | Matsumoto | 156/361 |
| 5,078,375 | 1/1992 | Stetdinger | 270/52.09 |
| 5,079,901 | 1/1992 | Kotsiopoulos | 53/435 |
| 5,314,560 | 5/1994 | Pritchet | 156/238 |
| 5,549,233 | 8/1996 | Clauser | 225/100 |
| 5,588,280 | 12/1996 | Kotsiopoulos | 53/435 |
| 5,658,638 | 8/1997 | Pottenger | 428/126 |
| 5,667,614 | 9/1997 | Fogle | 156/247 |
| 5,784,861 | 7/1998 | Kotsiopoulos | 53/435 |

FOREIGN PATENT DOCUMENTS

| | | | |
|---|---|---|---|
| 877824 | 8/1971 | Canada | 271/4 |

OTHER PUBLICATIONS

Hurletron Inc. Drawing No. 493886, Rev. 0, 1 sheet, prior art.

Pending U.S. Serial No. 09/054,293 filed Apr. 2, 1998 and entitled "Apparatus for Affixing Cards to a Moving Web," named inventors Steven Siler and Cornelius deVeer and assigned to Hurletron, Incorporated.

*Primary Examiner*—Eugene Eickholt

*Attorney, Agent, or Firm*—Marshall, O'Toole, Gerstein, Murray & Borun

[57] ABSTRACT

An apparatus is disclosed for automatically affixing notes to a moving printed web which has a plurality of repeat lengths, each of the notes being automatically applied at the same relative location in each of a plurality of repeat lengths of the printed web. The apparatus includes a note feed device adapted to receive a note web consisting of a carrier web and a plurality of removable notes disposed on the carrier web. The apparatus also includes a note handler operatively coupled to separate the notes from the carrier web and cause them to be applied to the printed web and a controller adapted to control the note feed device so as to cause each of the notes to be applied to the printed web in a predetermined position in each of the repeat lengths of the printed web.

20 Claims, 7 Drawing Sheets

APPARATUS FOR AFFIXING REMOVABLE NOTES TO A MOVING WEB

BACKGROUND OF THE INVENTION

The present invention is directed to an apparatus for automatically affixing pre-printed removable notes to a moving printed paper web in synchronism with the moving web so that each of the notes is affixed to the moving web at a predetermined position in a repeat length of the moving web.

An apparatus for affixing cards to a moving web of the type relating to the invention is disclosed in U.S. Pat. No. 4,351,517 to Neal, et al. That apparatus has a rotating feed roll 30 that receives a strip or web 12 of pre-printed cards and feeds the web of cards to an applicator drum 80 that periodically causes one of the pre-printed cards to be separated from the card web 12 and applied to a moving web 108 having a number of pre-printed pages.

A prior art apparatus of the type described in the Neal et al. patent and marketed by Hurletron Incorporated, which was used to affix pre-printed cards having registration holes formed therein to a moving printed web using a card feed device with registration pins as described above, was provided with a controller to synchronize the movement of the web of pre-printed cards, which was moving at a first relatively low speed, to the movement of a printed web onto which the cards were to be affixed, which printed web was moving at a second, relatively fast speed. The controller was identical to the controller shown in FIG. 9 of this patent, and the controller included a computer program substantially identical to the one that is illustrated by the flowchart shown in FIGS. 10A–10C of this patent.

SUMMARY OF THE INVENTION

The invention is directed to an apparatus for automatically affixing notes having printed subject matter thereon to a printed web moving at a first speed and having a plurality of repeat lengths. Each of the notes is automatically applied to a successive one of the repeat lengths of the printed web at the same relative location in each of the repeat lengths. The apparatus is provided with a note feed device adapted to receive a note web having a carrier web on which a plurality of notes with printed subject matter thereon are removably disposed, a note separation mechanism adapted to separate the notes from the carrier web, a note handler adapted to automatically apply the notes to the printed web after the notes have been separated from the carrier web, and a controller operatively coupled to the note feed device. The controller is adapted to control the note feed device to cause the note web to move at a second speed slower than the first speed and to cause each of the notes to be applied to the printed web in a predetermined position in each of the repeat lengths of the printed web.

The carrier web may have a first side on which the notes are disposed and a second side, the carrier web may travel in a first direction when the notes are disposed thereon, and the note separation mechanism may include a delamination mechanism disposed to make contact with the second side of the carrier web and a web conveyor that pulls the carrier web away from the delamination mechanism in a second direction that is different than the first direction so that the carrier web travels in the first direction until the carrier web reaches the delamination mechanism and so that the carrier web travels in the second direction after the carrier web passes by the delamination mechanism.

The note handler may comprise a vacuum drum having an interior portion in which a suction pressure is provided and a cylindrical outer portion in which a plurality of holes are formed, and the web conveyor may be provided in the form of a pair of rollers between which the carrier web passes. The delamination member may be a bar or rod which makes contact with the entire width of the second side of the carrier web.

In another aspect of the invention, the feed device is designed so that there is substantially no slippage between the feed device and the carrier web, with the feed device being adapted to cause the carrier web to pass through the feed device without the use of registration pins, the controller is adapted to maintain synchronism between the speed of the carrier web and the speed of the printed web, and the controller is adapted to maintain a predetermined phase relationship between the carrier web and the printed web.

The invention is also directed to a method of automatically affixing notes having printed subject matter thereon to a printed web moving at a first speed, the printed web comprising a plurality of repeat lengths and each of the notes being automatically applied to a successive one of the repeat lengths at the same relative location in each of the repeat lengths. The method includes the steps of: (a) providing a note web to a note feed device, the note web having a carrier web on which a plurality of notes with printed subject matter thereon are removably disposed; (b) passing the note web through the note feed device at a second speed slower than the first speed; (c) separating the notes from the carrier web; and (d) periodically affixing one of the notes to the printed web so that each of the notes is applied to the printed web at a predetermined position in each of the repeat lengths of the printed web.

Step (b) may include the step of passing the note web over a rotatable cylindrical feed wheel while the feed wheel is rotating at a rotational speed, and step (c) may include the steps of (c1) passing the carrier web around a delamination mechanism and (c2) pulling the carrier web away from the delamination mechanism in a second direction that is different than the first direction so that the carrier web travels in the first direction until the carrier web reaches the delamination mechanism and so that the carrier web travels in the second direction after the carrier web passes by the delamination mechanism.

The features and advantages of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
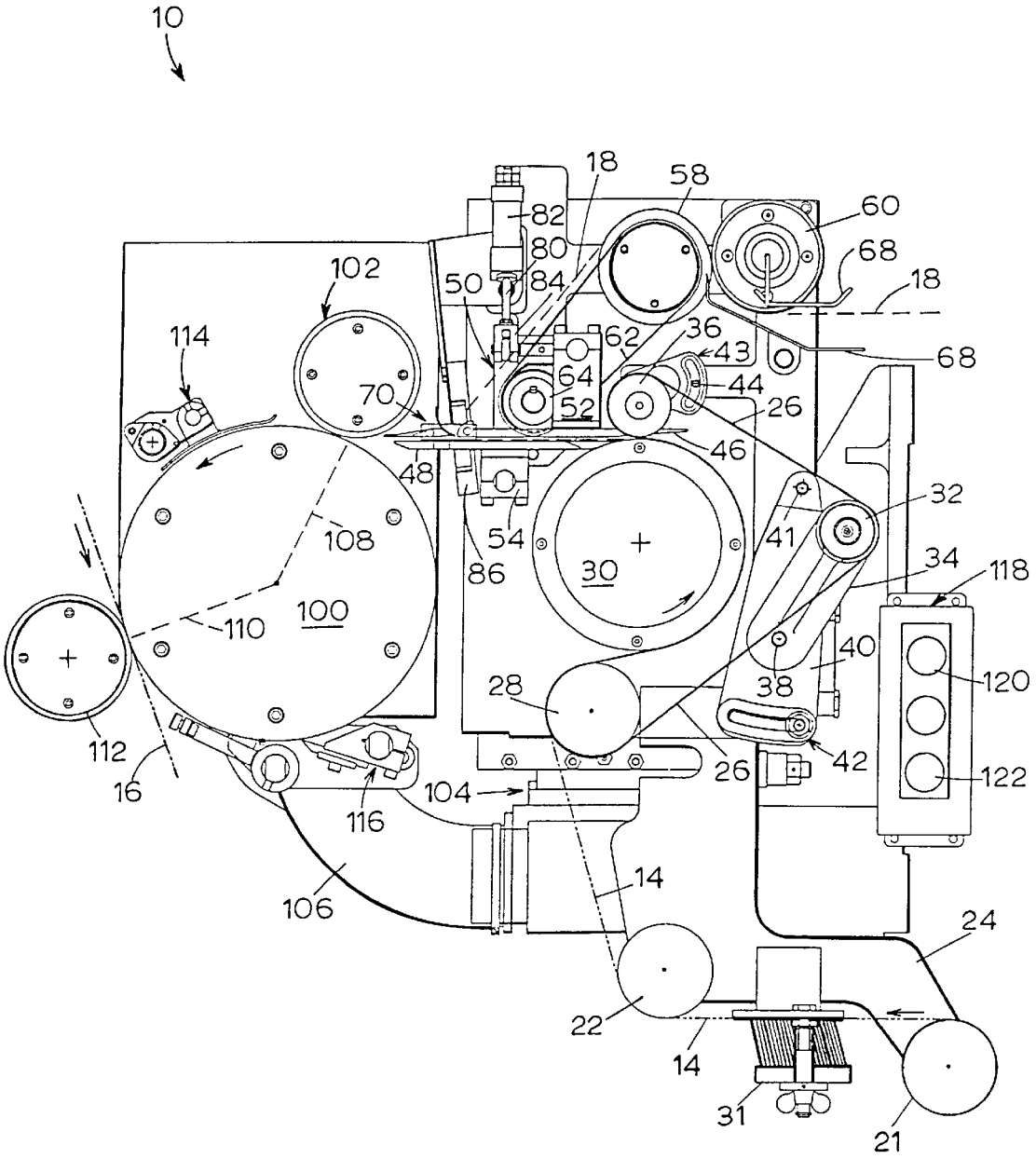
FIG. 1 illustrates the mechanical portions of a preferred embodiment of an applicator for affixing pre-printed notes to a moving printed web.
Figure 2:
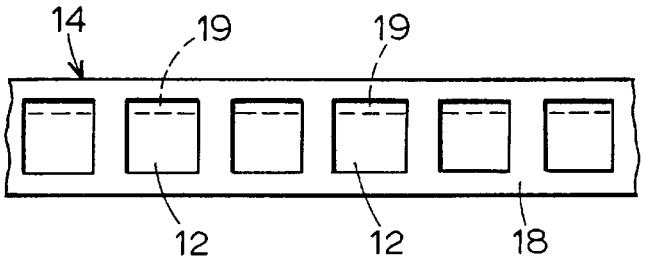
FIG. 2 illustrates a note web which is fed to the note applicator during operation of the applicator.

FIG. 1 illustrates the mechanical portions of a note applicator 10 for automatically affixing pre-printed paper notes 12 (FIG. 2) of a note web 14 to a moving printed web 16. As shown in FIG. 2, the note web 14 consists of pre-printed notes 12, which may be Post-it ® brand notes marketed by Minnesota Mining and Manufacturing Co., adhesively coupled to a carrier web 18 at spaced locations along the carrier web 18. The carrier web 18 may be composed of a material similar to wax paper to facilitate easy removal of the notes 12. Each of the notes 12 has an adhesive area or strip 19 which holds the note 12 on the web 18.

Figure 3:
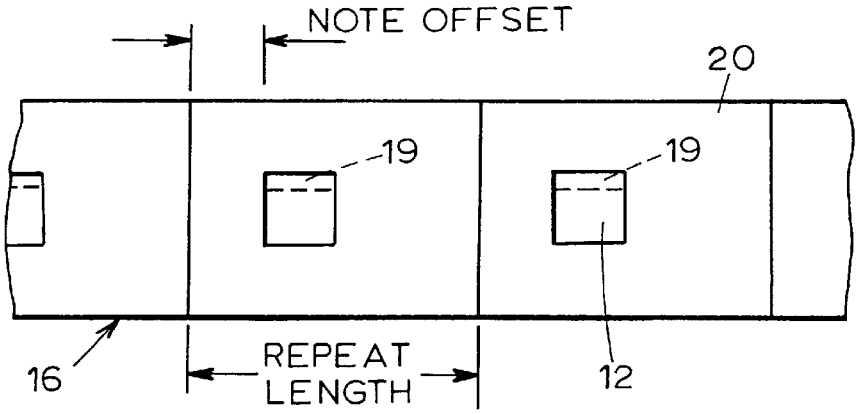
FIG. 3 illustrates a portion of a printed web having a number of pre-printed notes affixed thereto.

During operation, the note web 14 is fed to the applicator 10, which removes or separates the notes 12 from the carrier web 18 and then applies each note 12 to the moving printed web 16. The printed web 16 is pre-printed to have an identical image printed in each of a number of adjacent repeat lengths, such as a repeat length corresponding to a page of an advertising flyer or magazine. FIG. 3 illustrates a portion of the printed web 16 showing two full pages 20 each of which has a note 12 affixed to it in a predetermined position on each page 20.

Referring to FIG. 1, the note web 14 is drawn into the note applicator 10 via a pair of idler rollers 21, 22 rotatably mounted to a support arm 24, and moves in the direction of the arrows. Each of the idler rollers 21, 22 may have a pair of larger-diameter collars (not shown) between which the note web 14 passes. If used, the collars of each roller 21, 22 may be spaced apart by a distance generally corresponding to the width of the note web 14 so as to maintain the note web 14 in a predetermined lateral position.

After passing over the idler rollers 21, 22, the note web 14 passes over a tension belt 26 supported by a lower support roller 28, and then the note web 14 passes between the tension belt 26 and a rotatable feed wheel 30. The feed wheel 30, which may have an outer surface composed of smooth aluminum, is rotatably driven in a manner described below. The belt 26 is not driven, but moves at the same speed as the note web 14 due to the tension of the belt 26 and the friction between the note web 14 and the tension belt 26.

A brush 31 is mounted to the support arm 24 so that the ends of the bristles of the brush 31 make contact with the note web 14. The purpose of the brush 31 is to provide frictional contact with the note web 14 so that no slack occurs in portion of the note web 14 between the roller 22 and the roller 28.

The tension belt 26 is further supported by a side roller 32 rotatably mounted to a pivot arm 34 and an upper roller 36. The pivot arm 34 has an end pivotally connected at a pivot point 38 to a pivotable positioning plate 40. The pivot arm 34, which is spring-biased relative to the positioning plate 40 in a direction away from the feed wheel 30, is adapted to hold the belt 26 in a tightened state so that resulting tension of the belt 26 forces the note web 14 against the feed wheel 30 so that there is no slippage between the note web 14 relative to the feed wheel 30, as described in more detail below.

The positioning plate 40 is pivotable about a pivot point 41. To adjust the position of the side roller 32, the position of the plate 40 is pivotally adjusted about the pivot point 41, and then a nut 42 is tightened to maintain the plate 40 in the desired position. The upper roller 36 is mounted to a pivotable positioning plate 43, which may be moved to a desired position and then held in place by tightening a nut 44.

Figure 5:
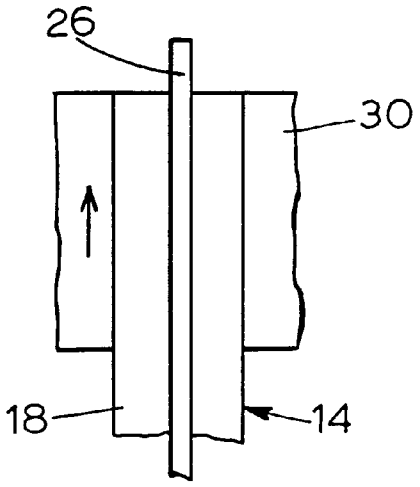
FIG. 5 is a side view of a portion of the feed wheel of the note applicator of FIG. 1 showing the relative position of a note web and a tension belt.

As shown in FIG. 5, the tension belt 26 may have a width smaller than the width of the note web 14, and the note web 14 is oriented so that the carrier web 18 makes continuous contact with the tension belt 26 and so that the notes 12 positioned on the carrier web 18 face the feed wheel 30.

Referring to FIG. 1, after being in contact with the feed wheel 30 for approximately half the circumference of the feed wheel 30, the note web 14 passes between an upper guide 46 composed of one or more elongate guide members and a lower guide 48 composed of one or more elongate guide members. The upper guide 46 is attached to a web guide assembly 50 via a clamp 52, and the lower guide 48 is attached to the note applicator 10 via a clamp 54.

Figure 4:
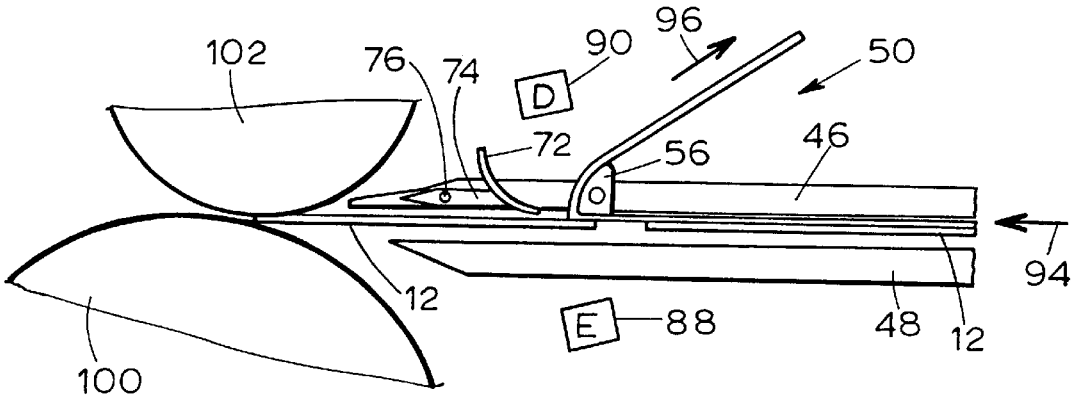
FIG. 4 is a view of a portion of the note applicator shown in FIG. 1.

A delamination mechanism in the form of a rod or bar 56 (FIG. 4) is mounted to the web guide assembly 50, and during operation of the note applicator 10 the carrier web 18 is pulled over the delamination bar 56 and away from the bar 56 in an upward and rightward direction as shown in FIGS. 1 and 4. The carrier web 18 is pulled over and away from the delamination bar 56 via a web conveyor in the form of a pair of rollers 58, 60, with the carrier web 18 passing between the contact point between the rollers 58, 60. The roller 58 is rotatably driven by a belt 62 connected to a drive pulley 64 driven by a motor 65 (FIG. 9), which also rotatably drives the feed wheel 30. A suitable gear or drive mechanism 66 (FIG. 9) may be used so that the pulley 64 is driven at a proper rate relative to the feed wheel 30. The surface of the roller 58 may be driven at a slightly faster rate than the surface of the feed wheel 30 to create a suitable amount of tension to facilitate uniform separation of the carrier web 18 from the notes 12. The rollers 58, 60 may be provided with one or more appropriate web deflectors or guards 68 to ensure that the carrier web 18 travels in the desired path away from the note applicator 10.

A web deflector 70 is attached to the web guide assembly 50. As shown in FIGS. 1 and 4, the web deflector 70 has a curved member 72 connected to a support member 74 which is pivotable about a pivot point 76 and upwardly biased to the position shown in FIG. 4. The purpose of the web deflector 70 is to facilitate initial threading of the note web 14 in the note applicator 10. To that end, the web deflector 70 is pushed downwards before the leading edge of the note web 14 reaches the delamination bar 56 so that the curved portion of the web deflector 70 deflects the leading edge of the web 14 upwardly so that the leading edge can be grasped by an operator and threaded between the rollers 58, 60.

The web guide assembly 50 is pivotable about a horizontal axis so that the small space between the upper and lower guides 46, 48 can be increased to allow access to the note web 14 at that point. The pivoting of the web guide assembly 50 is controlled by a piston rod 80 actuated by a cylinder 82. The lower end of the piston rod 80 is connected to the web guide assembly 50 via a clevis 84. When the piston rod 80 is drawn upwards into the cylinder 82, the web guide assembly 50 is moved from its closed position shown in FIGS. 1 and 4 to an open position in which the guides 46, 48 are spaced angularly apart.

The note applicator 10 has a support bracket 86 on which a note sensor is provided. The note sensor, which is used to detect the notes 12 as they pass between the guides 46, 48, may be provided in the form of a light emitter 88 and a light detector 90, as shown in FIG. 4 (the bracket 86 is not shown in FIG. 4 for purposes of simplicity). A trailing or leading edge of each of the notes 12 may be detected upon the detection of light, as detected by the light detector 90, from the light emitter 88.

Referring to FIG. 4, during operation of the note applicator 10, the note web 14 passes between the upper and lower guides 46, 48 until the web 14 reaches the delamination bar 56. The note web 14 is threaded through the note applicator 10 so that the carrier web 18 is adjacent the upper guide 46 and so that the notes 12 are adjacent the lower guide 48. As the carrier web 18 passes over the delamination bar 56, the carrier web 18 is pulled upwardly and to the right so that the carrier web 18 changes direction from an initial direction indicated by an arrow 94 to a new direction indicated by an arrow 96. The change of direction, which is shown in FIG. 4 to be approximately 135°, is preferably at least about 90°.

As each note 12 reaches the delamination bar 56, the note 12 continues to travel in its original direction, away from the carrier web 18, while the carrier web 18 moves in the new direction. Each note 12 continues moving forward (to the left in FIG. 4) until it reaches a note handler which includes a vacuum drum 100 and a nip wheel 102. The leading edge of each note 12 is gripped by the intersection of the vacuum drum 100 and the nip wheel 102 while the trailing edge of the note 12 is still adhesively connected to the carrier web 18, as shown in FIG. 4. The nip wheel 102, which may be rubber, has a relatively narrow width, e.g. about one inch, so that the nip wheel 102 does not come in contact with the upwardly facing adhesive portion 19 on the side of each note 12 (see FIG. 2).

Referring to FIG. 1, to accommodate notes 12 of different sizes, the horizontal distance between the vacuum drum 100 and the nip wheel 102 may be adjusted by moving the right-hand portion of the note applicator 10, on which the web guide assembly 50 is mounted, relative to the left-hand portion of the note applicator 10, on which the vacuum drum 100 and nip wheel 102 are supported, via a slide bearing 104.

In order to affix each note 12 to the same relative location on each page 20 of the printed web 16, the speed at which the printed web 16 passes through the note applicator 10 must be greater than the speed at which the note web 14 passes through the note applicator 10, since the size of a note 12 is smaller than the size of a page 20 to which the note 12 is affixed, as shown in FIG. 3. The vacuum drum 100 is driven to rotate so that the speed of the outer cylindrical surface of the vacuum drum 100 is the same as the speed of the printed web 16. Thus, the surface speed of the outer surface of the vacuum drum 100 and that of the nip wheel 102, which is in contact with the vacuum drum 100, is greater than the speed at which the note web 14 is fed by the feed wheel 30.

After the leading note 12 is separated from the carrier web 18, that note 12 is held in place on the vacuum drum 100 by a reduced or suction pressure. The vacuum drum 100 has a hollow interior portion in which a reduced or suction pressure is provided and an outer cylindrical surface with a plurality of holes formed therein so that the suction pressure is communicated to the surface of the vacuum drum 100. The suction pressure in the interior of the vacuum drum 100 is provided via a vacuum conduit or duct 106 that is pneumatically coupled to a vacuum pump (not shown).

The suction pressure may be provided only to an angular portion of the surface of the vacuum drum 100, such as the portion between the dotted line 108 and the dotted line 110, so that the note 12 is held in place until it makes contact with the printed web 16 at the intersection of the vacuum drum 100 with a pressure roller 112. The pressure roller 112 presses the printed web 16 against each note 12 so that the adhesive portion 19 on each note 12 holds the note 12 to the printed web 16.

The nip wheel 102 may be provided with an adjustment mechanism (not shown) in the form of a piston/cylinder assembly eccentrically coupled to a movable axle that rotatably supports the nip wheel 102, so that the nip wheel 102 can be moved between an operative position in which it makes contact with the vacuum drum 100 and a non-operative position in which it is spaced from the vacuum drum 100. Such an adjustment mechanism is disclosed in U.S. Ser. No. 09/054,293 filed Apr. 2, 1998 and entitled "Apparatus for Affixing Cards to a Moving Web," which is incorporated herein by reference.

A note guide 114 may be mounted adjacent the vacuum drum 100 between the nip wheel 102 and the pressure roller 112. The purpose of the note guide 114 is to prevent, in the event of loss of suction pressure in the vacuum drum 100, errant notes 12 from contacting the printed web 16. The note applicator 10 may also include a teflon wiper blade assembly 116 which makes contact with the outer surface of the rotating vacuum drum 100 and a switch box 118 having various operator control buttons such as a start/stop button 120 and an emergency stop button 122.

The tension belt 26 shown in FIGS. 1 and 5, which may be a rubber belt with internal fiber strands about 20 millimeters wide and two millimeters thick, is adapted to force the note web 14 against the feed wheel 30 so that the combination of the coefficient of friction between the cylindrical surface of the feed wheel 30 and the note web 14 and the force applied by the tension belt 26 are sufficient so that there is substantially no slippage between the note web 14 and the feed wheel 30 as the feed wheel 30 is rotatably driven.

Figure 6:
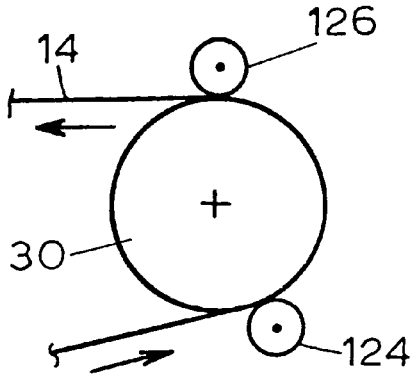
FIG. 6 illustrates a first alternative embodiment of a feed device for feeding a note web.

Instead of using the particular note feed device described above, other note feed devices could be utilized. FIG. 6 illustrates a first alternative embodiment in which a pair of pressure rollers 124, 126 are used instead of the tension belt 26. One of the pressure rollers 124 is positioned adjacent the note web 14 at a point where the web 14 first makes contact with the feed wheel 30, and the other pressure roller 126 is positioned adjacent the point where the web 14 leaves the feed wheel 30. The pressure rollers 124, 126 may be provided with rubber or other compressible coatings.

Figure 7:
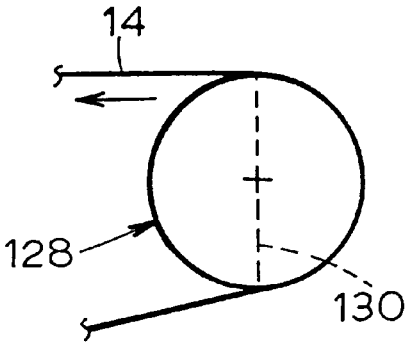
FIG. 7 illustrates a second alternative embodiment of a feed device for feeding a note web.

In a second alternative embodiment shown in FIG. 7, the feed wheel 30 is replaced by a vacuum drum 128 which applies a suction pressure to the note web 14 in contact with the vacuum drum 128. The suction pressure may be applied only to a portion of the surface of the drum 128, such as the portion to the right of dotted line 130. The combination of the coefficient of friction between the outer cylindrical surface of the vacuum drum 128 and the note web 14 and the vacuum force holding the note web 14 to the vacuum drum 128 should be sufficient to prevent any significant slippage between the note web 14 and the vacuum drum 128.

Figure 8:
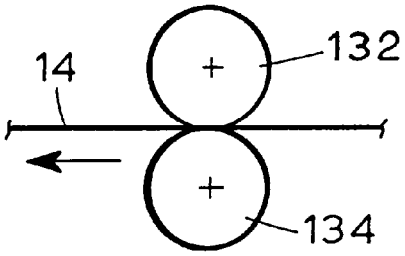
FIG. 8 illustrates a third alternative embodiment of a feed device for feeding a note web.

In a third alternative embodiment shown in FIG. 8, the feed wheel 30 and the tension belt 26 are replaced by a pair of precision pressure rollers 132, 134 which feed the note web 14 in a horizontal direction as shown by the arrow in FIG. 8. One or both of the rollers 132, 134 could be provided with a rubber or compressible surface to prevent slippage of the note web 14 relative to the precision rollers 132, 134.

As a further alternative, in order to prevent the note web 14 from slipping relative to the feed wheel 30, the circumference of the feed wheel 30 could be provided with registration pins (not shown), and the carrier web 18 could be provided with registration holes (not shown) spaced to receive the registration pins of the feed wheel 30, as disclosed in U.S. Pat. No. 4,351,517 to Neal, et al., which is incorporated herein by reference.

Other details regarding the structure of the mechanical portion of the note applicator 10 described above are disclosed in the Neal, et al. Although a particular mechanical structure for the note applicator 10 is described above, numerous modifications could be made to that structure without departing from the invention.

Figure 9:
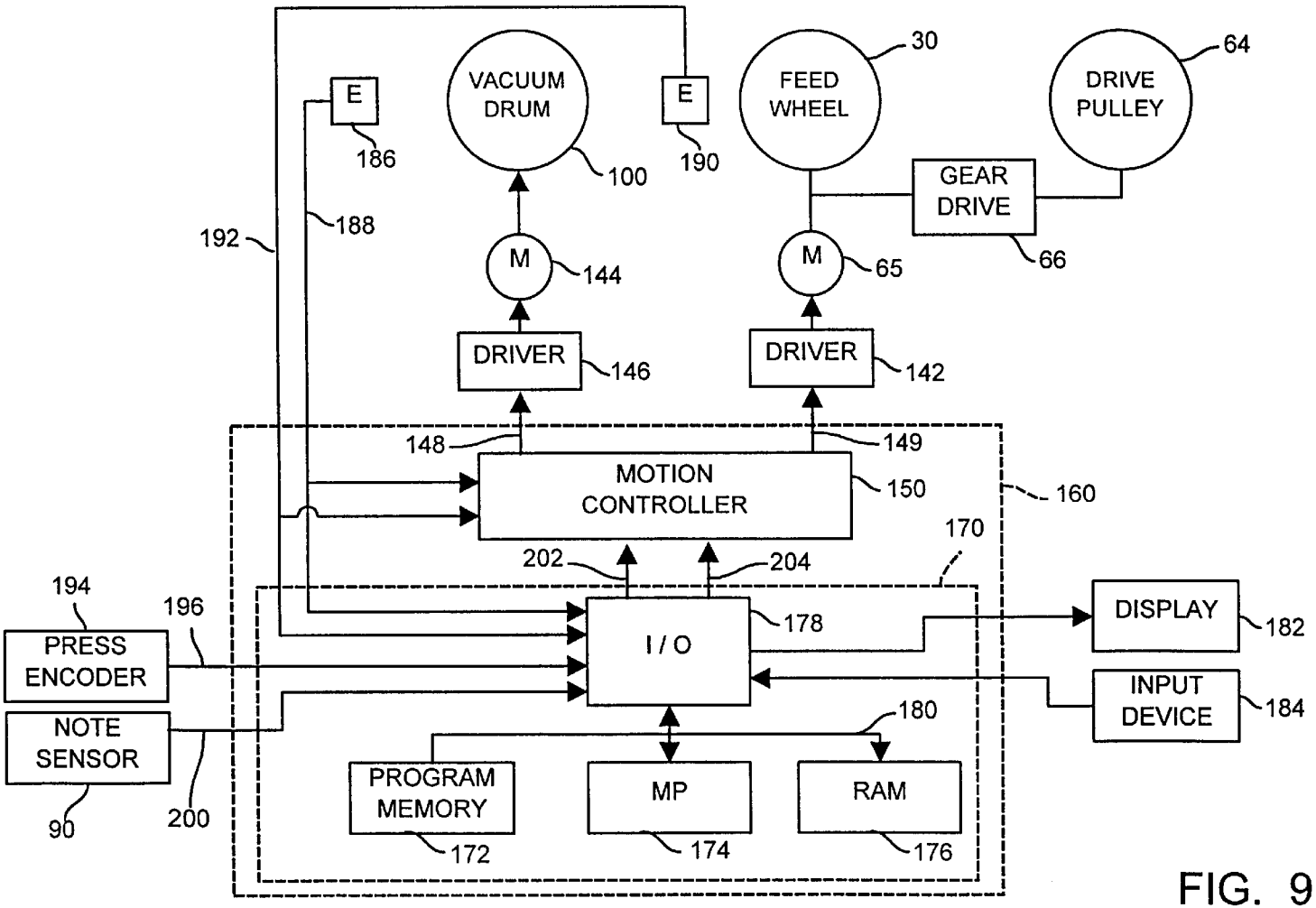
FIG. 9 is a block diagram illustrating the electronics portion of the note applicator shown in FIG. 1.

FIG. 9 is a block diagram of the control portion of the note applicator 10 which controls the rotational speed of the feed wheel 30, the drive pulley 64 and the vacuum drum 100. Referring to FIG. 9, the feed wheel 30 and the drive pulley 64 are rotatably driven by the motor 65 in response to drive signals generated by a conventional drive circuit 142. Similarly, the vacuum drum 100 is rotatably driven by a motor 144 in response to drive signals generated by a drive circuit 146. The drive signals output by the two drive circuits 142, 146 are generated in response to control signals provided to the drive circuits 142, 146 via a number of control lines 148, 149 generated by a motion controller 150, which may be a conventional motion controller commercially available from MEI Incorporated.

The motion controller 150 forms part of an overall controller 160, which also includes a main controller 170. The main controller 170 may be a conventional controller, such as a personal computer, having a program memory 172, such as a read-only memory (ROM), a microprocessor (MP) 174, a random-access memory (RAM) 176 and an input-output (I/O) circuit 178, all of which are interconnected via an address/data bus 180. The main controller 170 may be connected to a display device 182, such as a CRT, and to an input device 184, such as a keyboard.

The control portion of the note applicator 10 has a sensor 186, such as a shaft encoder, associated with the vacuum drum 100 that generates a signal indicative of the angular position or rotation of the vacuum drum 100. For example, the sensor 186 may generate a predetermined number of pulses, such as 10,000, for each complete revolution of the vacuum drum 100, or alternatively may generate a predetermined number of pulses, such as 5,000, for a predetermined rotational distance of the vacuum drum, such as one foot. The signal generated by the sensor 186 is transmitted to the motion controller 150 and to the I/O circuit 178 via a signal line 188. The note applicator 10 includes a sensor 190, such as a shaft encoder, associated with the feed wheel 30 that generates a signal indicative of the angular position or rotation of the feed wheel 30 and transmits the signal to the motion controller 150 and to the I/O circuit 178 via a signal line 192.

The note applicator 10 has a sensor in the form of a press encoder 194 that is operatively coupled to a portion of the printing press (not shown) that prints the printed web 16. The press encoder 194 generates a signal indicative of the speed and position of the printed web 16 and transmits that signal to the I/O circuit 178 via a signal line 196.

As described above, the note applicator 10 has a note detector 90 that generates a signal upon detecting an edge of a note 12, such as the trailing edge of the note 12, and transmits that edge-detect signal to the I/O circuit 178 via a line 200.

In response to the signals provided by the sensors 90, 186, 190, 194, the main controller 170 generates a pair of control signals on a pair of lines 202, 204 to the motion controller 150 to adjust the rotational speed of the feed wheel 30 (and the drive pulley 64) and the vacuum drum 100.

Figure 10A:
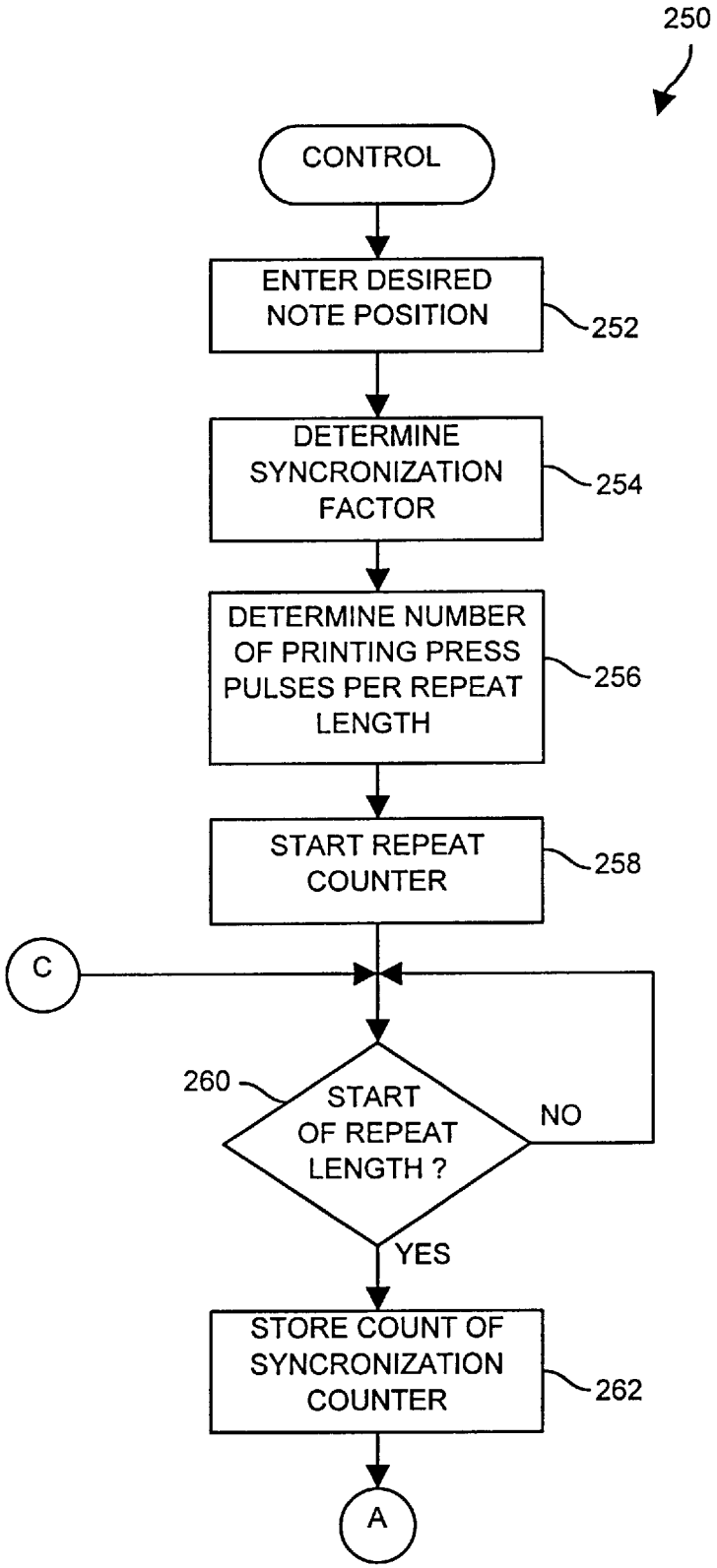
FIGS. 10A–10C are a flowchart of a computer program incorporated in the controller shown in FIG. 9 for controlling the operation of the note applicator.
Figure 10B:
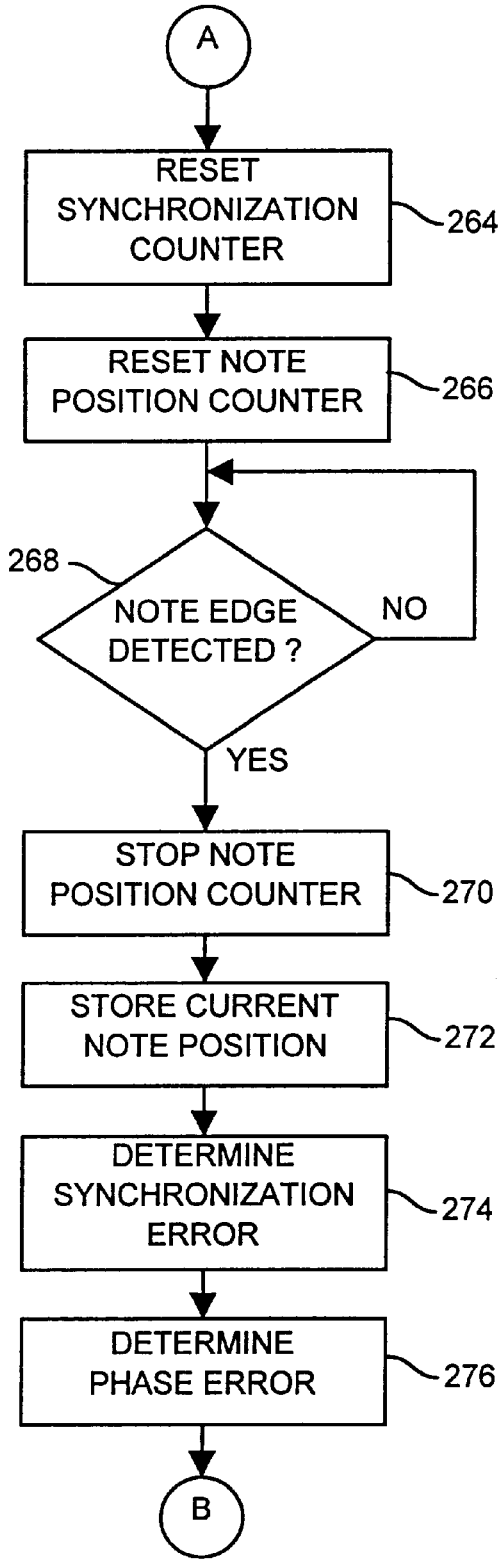
Figure 10C:
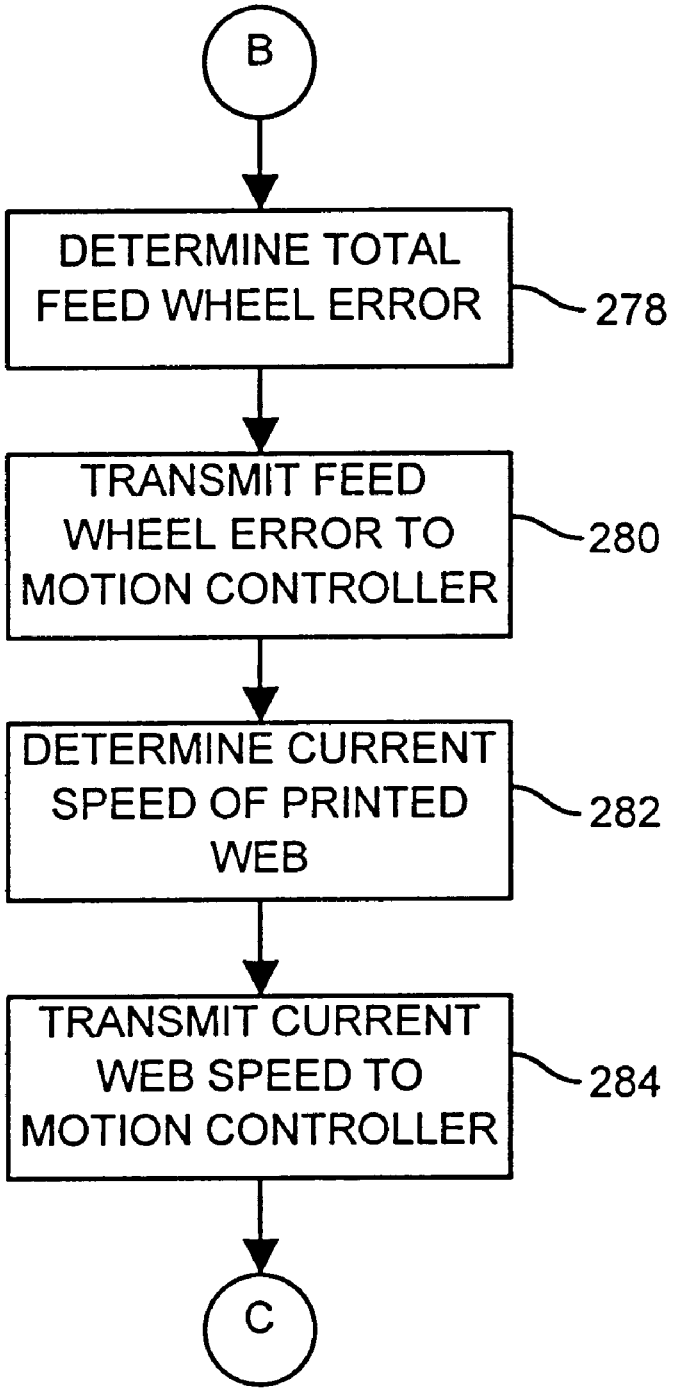

Figs. 10A through 10C illustrate a flowchart of a computer program control routine 250 that is performed by the main controller 170 to control the rotational speed of the feed wheel 30 and the vacuum drum 100 during operation of the note applicator 10. The control routine 250 performs the following basic functions: 1) it causes the vacuum drum 100 to be rotatably driven so that the speed at which the outer surface of the vacuum drum 100 travels is substantially the same as the speed of the printed web 16; 2) it causes the rotational speed of the feed wheel 30 to be synchronized to the speed of the printed web 16 so that exactly one note 12 is fed for each repeat length or page 20 of the printed web 16; and 3) it causes the rotational speed of the feed wheel 30 to be phase-controlled so that each note 12 is placed at the same predetermined position in each repeat length or page 20 of the printed web 16.

Referring to FIG. 10A, the control routine 250 begins operation at step 252 where the operator enters, via the input device 184, the relative position on the page 20 at which it is desired to place the notes 12. For example, this position could correspond to the note offset, in inches for example, shown in FIG. 3.

The offset position entered by the operator, if entered in units of distance, may be translated into other units, such as the number of pulses that would be generated by the press encoder 194 during movement of the printed web 16 for a distance corresponding to the offset position. For example, if the operator entered an offset position of three inches, and if the press encoder 194 generates 10,000 pulses per foot of travel of the printed web 16, the translated offset position would be 2,500 pulses (10,000 pulses per foot multiplied by 0.25 feet).

At step 254, a synchronization factor used to synchronize the rotation of the feed wheel 30 with the speed of the printed web 16 is determined. For example, if the length of a note 12 to be applied to the printed web 16 is three inches, and if the repeat length (or length of a page 20) of the printed web 16 is twelve inches, for every twelve inches of movement of the printed web 16, the outer surface of the feed wheel 30 must travel three inches to remain in synchronism with the printed web 16.

The synchronization factor determined at step 254 could be, for example, the number of pulses that should be generated by the feed wheel sensor 190 for each repeat length of the printed web 16. Thus, in the above example where the length of the notes 12 is three inches, if the feed wheel sensor 190 generates 10,000 pulses per foot, the synchronization factor in that case would be 10,000 pulses per foot of travel multiplied by 0.25 feet (three inch note length) to come up with a synchronization factor of 2,500 pulses per repeat length.

At step 256, the number of pulses that would be generated by the press encoder 194 coupled to the printing press that prints the printed web 16 for each repeat length of the printed web is determined based on the repeat length. For example, if the press encoder 194 generates 10,000 pulses per lineal foot of the printed web 16 and if the repeat length (see FIG. 3) was nine inches, step 256 would determine the number of printing press pulses per repeat length by multiplying 10,000 pulses per foot by 0.75 feet/repeat length to arrive at a number of 7,500 press pulses per repeat length.

At step 258, a repeat counter (not shown) is started. The repeat counter, which may be a conventional modulo counter implemented in software for example, continuously counts the number of pulses generated by the press encoder 194.

At step 260, the routine waits for the start of a repeat length. A repeat length (see FIG. 3) is considered to start when the number of press encoder pulses counted by the repeat counter reaches the predetermined number (determined at step 256) which corresponds to exactly one repeat length. Upon the start of repeat, the routine branches to step 262.

Upon each start of repeat, which corresponds to the travel of a single repeat length or page 20, steps 262 through 284 are performed to generate a pair of control signals that are sent to the motion controller 150 via the lines 202, 204, which cause the motion controller 150 to adjust the rotational speed of the feed wheel 30 (and the drive pulley 64) and the vacuum drum 100.

The note applicator 10 has a synchronization counter that is used to synchronize the rotation of the feed wheel 30 with the speed of the printed web 16. For example, the synchronization counter, which may be a counter implemented in software for example, may continuously count the number of pulses generated by the feed wheel sensor 190 to keep track of the rotational movement of the feed wheel 30. Since step 262 is performed once for each repeat length of the printed web 16, the count stored at step 262 represents the distance (measured in feed wheel pulses) through which the feed wheel 30 rotated during the last repeat length. At step 264, the synchronization counter is reset to zero, after which it continues to count the pulses generated by the feed wheel sensor 190.

The note applicator 10 includes a note position counter which is used to adjust the phase or position at which notes 12 are placed on the printed web 16. The note position counter may, for example, continuously count the number of pulses generated by the press encoder 194. At step 266, the note position counter is reset to zero since it is the start of a new repeat length as determined at step 260.

At step 268, the routine waits until the note sensor 90 detects the edge of the next note 12, at which time the program branches to step 270 where the note position counter is stopped, and then to step 272 where the current note offset position is stored by storing the count of the note position counter.

At step 274, the synchronization error between the rotation of the feed wheel 30 and the movement of the printed web 16 is determined, based upon the synchronization factor determined at step 254 and the synchronization count stored at step 262. In the example noted above in connection with step 254, the synchronization factor was 5,000 pulses of the feed wheel sensor 190 per repeat length. Using this example, if the synchronization count stored at step 262 corresponded to only 4,500 pulses (generated by the feed wheel sensor 190 during the repeat length), the synchronization error would be determined at step 274 to be 500 pulses (the difference between the synchronization factor and the synchronization count), which would mean that the rotational speed of the feed wheel 30 was too slow (by 500 pulses or about 10%).

At step 276, the phase or offset position error is determined based on the desired offset position entered by the operator at step 252 and the count of the note position counter as determined at step 270. For example, if the desired offset position of the notes 12 is three inches, corresponding to 2,500 pulses of the press encoder 194, and if the measured offset position of the note position sensor determined at step 272 corresponded to 2,000 pulses of the press encoder 194, the phase error determined at step 276 would correspond to the difference between the desired position and the measured position, or 500 pulses in this case (the note 12 would in this case be placed too close to the leading or left-hand edge of the page 20 by about 20% of the desired offset distance).

At step 278, the total error in the position of the feed wheel 30 is determined by adding the synchronization error determined at step 274 to the phase error determined at step 276, taking into account the sign of both errors (i.e. the feed wheel 30 could be too advanced in one case and could lag in the other). At step 280, the total error determined at step 278 is transmitted to the motion controller 150 via the control line 204, and the motion controller 150 causes the position and/or rotational speed of the feed wheel 30 to be adjusted via the control line 149.

Steps 282 and 284 are performed to control the vacuum drum 100 to cause it to rotate at the same speed at which the printed web 16 is moving. At step 282, the current speed of the printed web 16 is determined based upon the rate at which pulses are being received by the press encoder 194, for example. At step 284, the current speed of the printed web 16 is transmitted to the motion controller 170 via the control line 202, and the motion controller 150 causes the speed of the vacuum drum 100 to be adjusted (if necessary) to match the speed of the printed web 16, via the control line 148. After the completion of step 284, the program branches back to step 260 shown in FIG. 10A, where the program waits for the start of the next repeat length.

Although a specific manner of synchronizing the feed wheel 30 to the speed of the printed web 16 and of controlling the offset position at which notes 12 are affixed to the printed web 16, other methods of control could be utilized.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An apparatus for automatically affixing notes having printed subject matter thereon to a printed web moving at a first speed, said printed web having a plurality of repeat lengths, each of said notes being automatically applied to a successive one of said repeat lengths of said printed web at the same relative location in each of said repeat lengths, said apparatus comprising:

a rotatable feed wheel adapted to receive a note web comprising a carrier web on which a plurality of notes having printed subject matter thereon are removably disposed with an adhesive, said feed wheel having a cylindrical surface and said note web making substantially flush contact with said cylindrical surface of said feed wheel;

a motor operatively coupled to drive said feed wheel at a rotational speed;

a note separation mechanism adapted to separate said notes from said carrier web;

a note handler adapted to automatically apply said notes to said printed web after said notes have been separated from said carrier web; and a controller operatively coupled to said motor to control said rotational speed of said feed wheel so as to cause said note web to move at a second speed slower than said first speed and to cause said note handler to apply each of said notes to a predetermined position in each of said repeat lengths of said printed web.

2. An apparatus as defined in claim 1 wherein said note handler comprises a vacuum drum having an interior portion in which a suction pressure is provided and a cylindrical outer portion in which a plurality of holes are formed.

3. An apparatus as defined in claim 1 wherein said carrier web has a first side on which said notes are disposed and a second side, wherein said carrier web travels in a first direction when said notes are disposed thereon, and wherein said note separation mechanism comprises:

a delamination mechanism disposed to make contact with said second side of said carrier web; and a web conveyor that pulls said carrier web away from said delamination mechanism in a second direction that is different than said first direction so that said carrier web travels in said first direction until said carrier web reaches said delamination mechanism and so that said carrier web travels in said second direction after said carrier web passes by said delamination mechanism.

4. An apparatus as defined in claim 3 wherein said web conveyor comprises a pair of rollers between which said carrier web passes.

5. An apparatus as defined in claim 3 wherein said delamination member comprises a bar which makes contact with the entire width of said second side of said carrier web.

6. An apparatus as defined in claim 1 wherein said carrier web has a first side on which said notes are disposed and a second side, wherein said carrier web travels in a first direction when said notes are disposed thereon, and wherein said note separation mechanism comprises:

a delamination mechanism disposed to make contact with said second side of said carrier web; and a web conveyor that pulls said carrier web away from said delamination mechanism in a second direction which is different from said first direction by at least about 90° so that said carrier web travels in said first direction until said carrier web reaches said delamination mechanism and so that said carrier web travels in said second direction after said carrier web passes by said delamination mechanism.

7. An apparatus as defined in claim 1 wherein said controller comprises a motion controller and a main controller coupled to said motion controller.

8. An apparatus for automatically affixing notes having printed subject matter thereon to a printed web moving at a first speed, said printed web having a plurality of repeat lengths, each of said notes being automatically applied to a successive one of said repeat lengths of said printed web at the same relative location in each of said repeat lengths, said apparatus comprising:

a note feed device adapted to receive a note web comprising a carrier web on which a plurality of notes having printed subject matter thereon are removably disposed;

a note separation mechanism adapted to separate said notes from said carrier web;

a note handler adapted to automatically apply said notes to said printed web after said notes have been separated from said carrier web; and a controller operatively coupled to said note feed device, said controller being adapted to control said note feed device to cause said note web to move at a second speed slower than said first speed and to cause each of said notes to be applied to said printed web in a predetermined position in each of said repeat lengths of said printed web.

9. An apparatus as defined in claim 8 wherein said note handler comprises a vacuum drum having an interior portion in which a suction pressure is provided and a cylindrical outer portion in which a plurality of holes are formed.

10. An apparatus as defined in claim 8 wherein said carrier web has a first side on which said notes are disposed and a second side, wherein said carrier web travels in a first direction when said notes are disposed thereon, and wherein said note separation mechanism comprises:

a delamination mechanism disposed to make contact with said second side of said carrier web; and a web conveyor that pulls said carrier web away from said delamination mechanism in a second direction that is different than said first direction so that said carrier web travels in said first direction until said carrier web reaches said delamination mechanism and so that said carrier web travels in said second direction after said carrier web passes by said delamination mechanism.

11. An apparatus as defined in claim 10 wherein said web conveyor comprises a pair of rollers between which said carrier web passes.

12. An apparatus as defined in claim 10 wherein said delamination member comprises a bar which makes contact with the entire width of said second side of said carrier web.

13. An apparatus as defined in claim 8 wherein said carrier web has a first side on which said notes are disposed and a second side, wherein said carrier web travels in a first direction when said notes are disposed thereon, and wherein said note separation mechanism comprises:

a delamination mechanism disposed to make contact with said second side of said carrier web; and a web conveyor that pulls said carrier web away from said delamination mechanism in a second direction which is different from said first direction by at least about 90° so that said carrier web travels in said first direction until said carrier web reaches said delamination mechanism and so that said carrier web travels in said second direction after said carrier web passes by said delamination mechanism.

14. An apparatus for automatically affixing notes having printed subject matter thereon to a printed web moving at a first speed, said printed web having a plurality of repeat lengths, each of said printed notes being automatically applied to a successive one of said repeat lengths of said printed web at the same relative location in each of said repeat lengths, said apparatus comprising:

a feed device adapted to receive a carrier web having a plurality of said printed notes disposed thereon, said feed device being adapted to cause said carrier web to pass through said feed device so that there is substantially no slippage between said feed device and said carrier web, said feed device being adapted to cause said carrier web to pass through said feed device without the use of registration pins;

a note separation mechanism adapted to separate said notes from said carrier web;

a note handler adapted to automatically apply said notes to said printed web after said notes have been separated from said carrier web; and a controller operatively coupled to said feed device, said controller being adapted to control said feed device so as to cause said carrier web to move at a second speed slower than said first speed and to cause each of said printed notes to be applied to said printed web in a predetermined position in each of said repeat lengths of said printed web, said controller being adapted to maintain synchronism between said second speed of said carrier web and said first speed of said printed web, and said controller being adapted to maintain a predetermined phase relationship between said carrier web and said printed web.

15. An apparatus as defined in claim 14 wherein said feed device comprises a cylindrical feed wheel.

16. An apparatus as defined in claim 14 wherein said feed device comprises a pinless feed device.

17. An apparatus as defined in claim 14 wherein said handler comprises a vacuum drum having an interior portion in which a suction pressure is provided and a cylindrical outer portion in which a plurality of holes are formed.

18. A method of automatically affixing notes having printed subject matter thereon to a printed web moving at a first speed, said printed web comprising a plurality of repeat lengths, each of said notes being automatically applied to a successive one of said repeat lengths at the same relative location in each of said repeat lengths, said method comprising the steps of:

(a) providing a note web to a note feed device, said note web comprising a carrier web on which a plurality of notes having printed subject matter thereon are removably disposed;

(b) passing said note web through said note feed device at a second speed slower than said first speed;

(c) separating said notes from said carrier web; and (d) periodically affixing one of said notes to said printed web so that each of said notes is applied to said printed web at a predetermined position in each of said repeat lengths of said printed web.

19. A method as defined in claim 18 wherein said step (b) comprises the step of passing said note web over a rotatable cylindrical feed wheel while said feed wheel is rotating at a rotational speed.

20. A method as defined in claim 18 wherein said note web travels in a first direction and wherein said step (c) comprises the steps of:

(c1) passing said carrier web around a delamination mechanism; and (c2) pulling said carrier web away from said delamination mechanism in a second direction that is different than said first direction so that said carrier web travels in said first direction until said carrier web reaches said delamination mechanism and so that said carrier web travels in said second direction after said carrier web passes by said delamination mechanism.

* * * * *